US008152268B2

(12) United States Patent
Watanabe

(10) Patent No.: US 8,152,268 B2
(45) **Date of Patent: *Apr. 10, 2012**

(54) TUBE PUMP, LIQUID EJECTING APPARATUS, AND METHOD OF DRIVING TUBE PUMP

(75) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/914,166

(22) Filed: Oct. 28, 2010

(65) Prior Publication Data

US 2011/0044825 A1 Feb. 24, 2011

Related U.S. Application Data

(63) Continuation of application No. 12/053,273, filed on Mar. 21, 2008, now Pat. No. 7,841,693.

(30) Foreign Application Priority Data

Mar. 23, 2007 (JP) ..... 2007-076900

(51) Int. Cl.
*B41J 2/165* (2006.01)
*B41J 2/175* (2006.01)

(52) U.S. Cl. ..... 347/30; 347/85

(58) Field of Classification Search ..... 347/19, 347/30, 32, 84–85

See application file for complete search history.

(56) References Cited

U.S. PATENT DOCUMENTS

| | | | | |
|---|---|---|---|---|
| 6,082,977 | A | 7/2000 | Nishioka | |
| 6,641,249 | B2 | 11/2003 | Miyauchi | |
| 7,011,387 | B2 | 3/2006 | Saito et al. | |
| 7,841,693 | B2 * | 11/2010 | Watanabe | 347/30 |
| 2008/0158271 | A1 * | 7/2008 | Shimizu et al. | 347/7 |

FOREIGN PATENT DOCUMENTS

| | | |
|---|---|---|
| JP | 2002-349452 | 12/2002 |
| JP | 2003-312023 | 11/2003 |
| JP | 2006-044175 | 2/2006 |

* cited by examiner

*Primary Examiner* — Jason Uhlenhake
(74) *Attorney, Agent, or Firm* — Workman Nydegger

(57) ABSTRACT

A tube pump comprising a flexible tube, a pressing member capable of generating a negative pressure in the tube by sequentially pressing the tube from as the pressing member moves from an upstream portion of the tube to a downstream portion of the tube during a pump operating process, a rotating member which includes a cam surface which the pressing member comes in sliding contact with when the pressing member moves between a pump operating position where a negative pressure is generated in the upstream portion of the tube and a pump non-operating position where the negative pressure is not generated, and a rack member including a plurality of teeth, wherein the pressing member is provided with a pinion member capable of continuously engaging with the a flexible portion of the rack member when the pressing member rotatably moves between the pump non-operating position and the pump operating position.

13 Claims, 7 Drawing Sheets

UPSTREAM 28
31
43
48
45
45a
58
40
62
61
60
55
X
56
57
S
42
40b
45b
44
47
41
DOWNSTREAM

TUBE PUMP, LIQUID EJECTING APPARATUS, AND METHOD OF DRIVING TUBE PUMP

CROSS-REFERENCE TO A RELATED APPLICATION

This application is a continuation of U.S. patent application Ser. No. 12/053,273 filed Mar. 21, 2008, which claimed priority to Japanese Patent Application No. 2007-076900, filed Mar. 23, 2007. The entire disclosures of these applications are expressly incorporated herein by reference.

BACKGROUND OF THE INVENTION

1. Technical Field

The present invention relates to a tube pump More specifically, the present invention relates to a method of driving a tube pump and a liquid ejecting apparatus having the tube pump, which is capable of suppressing any irregular movements of the tube pump as it is switched from a non-operating position to an operating position.

2. Related Art

An ink jet printer is a liquid ejecting apparatus capable of ejecting a liquid onto a target from a liquid ejecting head. During a standard printing process, ink solvent vaporizes from series of openings in the nozzles formed on a nozzle formation surface of a printing or liquid ejecting head. As the solvent vaporizes, the ink solidifies, attracts dust, mixes with air to create bubbles, or the like. For any of these reasons, the nozzles may become clogged, and cause a printing failure. In order to alleviate these problems, the printer generally includes a maintenance unit capable of performing cleaning operation wherein the ink is sucked from the nozzles of the printing head to discharge any solidified ink, dust, or ink bubbles.

Typically, the maintenance unit includes a cam (liquid storage member) which comes in contact with the openings of the nozzles formed on the nozzle formation surface of the printing head and a sucking pump (sucking member) which is provided in an ink discharging passage communicating with the cam. The maintenance unit prevents ink ejection failure by generating a negative pressure in the cam using a sucking pump capable of sucking the ink from the nozzles where the ink with increased viscosity, dust, or air bubbles are formed. An example of one sucking pump currently used in the art is a tube pump disclosed in Japanese Patent Application No. JP-A-2002-349452.

The tube pump disclosed in JP-A-2002-349452 includes a substantially cylindrical housing which houses a midway portion in a flexible tube, a pump foil which rotates about an axis of the housing, and a roller or pressing member which is capable of pressing the tube while moving along an inner circumference of the housing while the pump foil is rotated in a predetermined direction. The midway portion of the tube is housed so as to be enclosed by the inner circumferential surface of the housing. A roller support groove is formed in the pump foil so as to form a curved groove. In addition, the roller support groove is formed so one end of the groove is closer to the shaft center of the pump foil, coinciding with the pump operation position, than on the other end, coinciding with the pump non-operation position. A shaft is inserted in the roller which protrudes from the shaft center and is slid into the roller support groove of the pump foil.

When the pump foil rotates in a pump operating direction, the roller rotates along the edge of the roller support groove. Then, because friction between the roller and the tube is smaller than the friction between the shaft of the roller and edge of the roller support groove, the shaft leaves the an area of the roller support groove associated with the non-operating position Therefore, when the rotation speed of the pump foil is faster than the speed at which the roller shaft slides along the inner circumference of roller support housing toward the pump operation position of the roller support groove.

At the pump operation position, the roller presses the tube to close the tube by causing the inner surfaces of the tube to come in close contact with each other. Accordingly, the roller moves along the inner surface of the housing while pressing a part of the tube against the inner circumference of the housing. When the roller moves, the portion of the tube that was previously pressed against the housing is successively restored to its previous shape, the upstream portion of the tube becomes depressurized, and the ink in the nozzle is sucked into the tube.

One problem with this configuration, however, is that when the roller moves from the pump non-operating position to the pump operating position as the pump foil is rotated toward the pump operating position, due to the difference in friction between the roller and tube and the friction between the roller shaft edge of the roller support groove. That is, the speed that the roller rotates between the pump non-operating position and the pump operating position of the roller depends on the difference between the two frictions. Unfortunately, however, the magnitude of the friction is often irregular due to variations in the environment (such as a temperature or humidity), or the reaction force varying because of irregularity in the tube shape.

Additionally, since the tube pump is mounted in the printer, ink may leak into the housing, lubricating the area between the roller and the tube, causing the friction between the roller and the tube to deteriorate.

In such instances, speed of rotation of the roller along the inner surface of the roller with the rotation is almost equal to the rotation speed of the pump foil. Without a substantial difference in these speeds, the roller shaft does not properly move in the roller support groove. As such, the roller may not adequately move from the pump non-operating position to the pump operating position, meaning that the tube pump may not function as a pump. Thus, it has difficult to successfully design the tube pump so that the difference in friction between roller and the tube and the friction caused by the roller shaft the roller support groove is constant and reliable.

BRIEF SUMMARY OF THE INVENTION

Aspects of the invention comprise a tube pump, a liquid ejecting apparatus, and a method of driving the tube pump capable which are capable of suppressing any irregular movement of a pressing member between a pump non-operating and a pump operating position.

A first aspect of the invention, is a tube pump including: a portion of tube made of a flexible material; a pressing member capable of generating a negative pressure by in the portion of tube by sequentially pressing the midway portion of the tube as the pressing member moves from an upstream portion of the tube to a downstream portion of the tube during a pump operating process; a rotating member which includes a cam surface which the pressing member comes into sliding contact with when the pressing member moves between a pump operating position where a negative pressure is generated in the upstream portion of the tube and a pump non-operating position where the negative pressure is not generated in the upstream portion of the tube; and a rack member corresponding with the cam surface and which includes a plurality of teeth. In the tube pump, the pressing member is provided with a pinion member which is capable of continuously engaging with a flexible portion of the rack member when the pressing member rotatably moves between the pump non-operating position to the pump operating position.

Another aspect of the invention is provided a liquid ejecting head including: a liquid ejecting head capable of ejecting a liquid from a nozzle; a liquid storage member capable of coming into contact with the liquid ejecting head; and a sucking member capable of sucking the liquid from the nozzle of the liquid ejecting head and discharging the liquid into the liquid storage member when the liquid storage member comes in contact with the liquid ejecting head. In the liquid ejecting apparatus, the sucking member comprises the tube pump described above.

A third aspect of the invention, is provided a method of driving a tube pump wherein a pressing member sequentially presses a portion of a flexible tube while sliding along a cam surface in order to generate a negative pressure in an upstream portion of the flexible tube in a pump operating process. The method comprises providing a rack member having a plurality of teeth along the cam surface and providing the pressing member with a pinion member capable of continuously engaging with a flexible portion of the rack member, and rotatably moving the pressing member from a pump non-operating position wherein a negative pressure is not generated in the upstream portion of the flexible tube to a pump operating position wherein the negative pressure is generated in the upstream portion of the flexible tube while engaging the pinion member with the rack member.

In these configurations, the pressing member rotatably moves from the pump non-operating position to the pump operating position during the pump operating process, causing the pinion member to engage with the rack member. Accordingly, the movement speed of the pressing member does not vary in accordance with the magnitude of the friction between the pressing member and the tube, unlike the known examples. Therefore, it is possible to suppress any irregular movement of the pressing member as it moves from the pump non-operating position to the pump operating position.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a tube pump, a liquid ejecting apparatus, and a method of driving the tube pump according to an embodiment of the invention will be described with reference to FIGS. 1 to 11. In addition, in the following description, the "front," "rear," "upward," "downward," "left," and "right" directions are as shown in FIG. 1.

Figure 1:
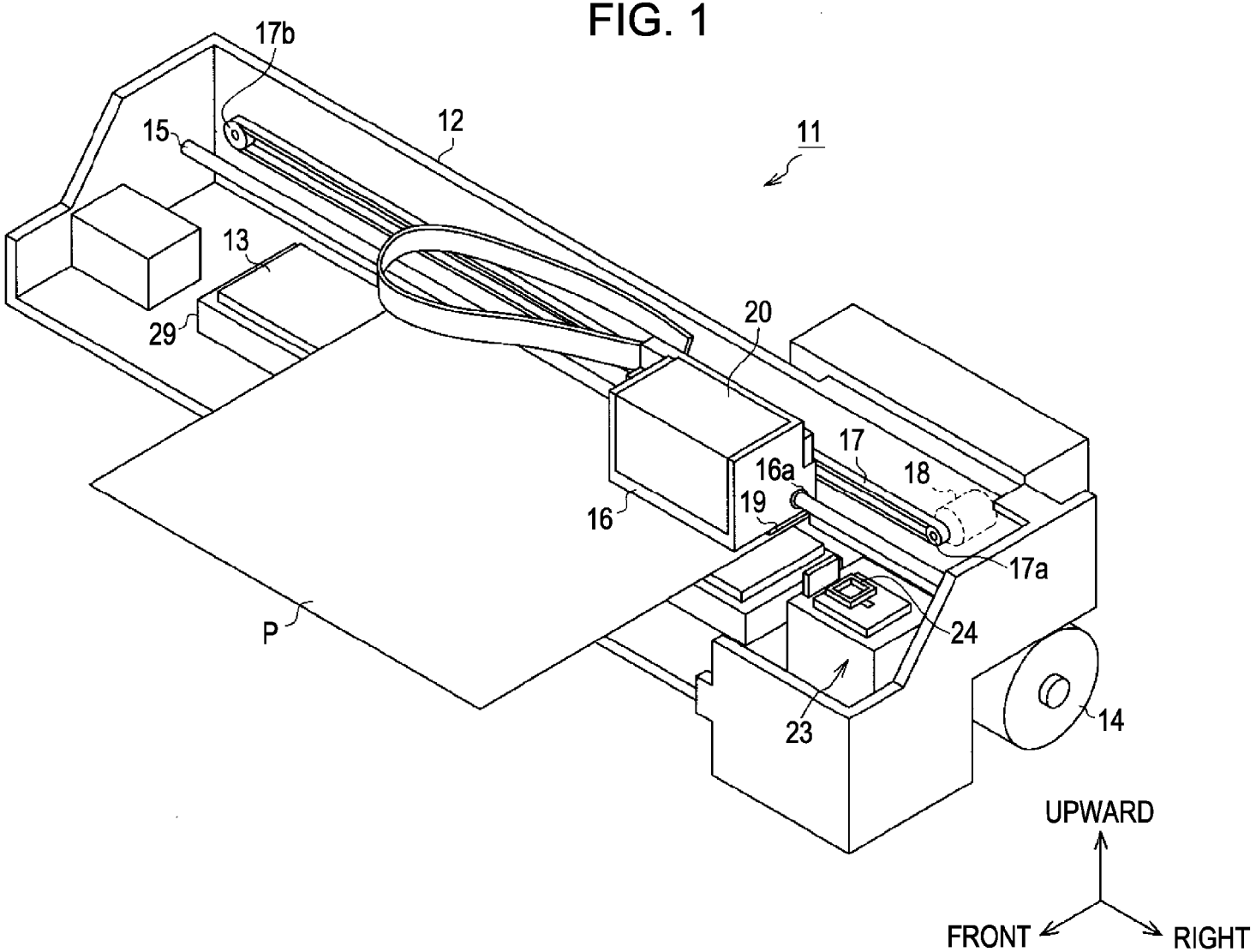
FIG. 1 is a schematic perspective view illustrating an ink jet printer according to an embodiment.

FIG. 1 shows an ink jet printer 11, which is an example of a liquid ejecting apparatus that may be used in association with the invention. The ink jet printer 11 includes a frame 12 with substantially a rectangular box shape. A platen 13 is arranged so as to extend along the in the right and left direction in the lower portion of the frame 12. A paper sheet P is configured to be fed from a rear side of the platen 13 by a sheet feeding mechanism (not shown) when a paper feeding motor 14 provided in the lower rear surface of the frame 12 is driven.

A guide shaft 15 is arranged along the upper portion of the platen 13. A carriage 16 is supported on the guide shaft 15 so as to reciprocate along the right and left direction along the guide shaft 15. The guide shaft 15 is inserted into a supporting hole 16*a* of the carriage 16, causing the carriage 16 to reciprocate along the length of the guide shaft 15.

A driving pulley 17*a* and a follower pulley 17*b* are supported in the inner rear surface of the frame 12 at a position that corresponds with the ends of the guide shaft. The driving pulley 17*a* and follower pulley 17*b* are each capable of rotating. An output shaft of a carriage motor 18 acts a driving source for enabling reciprocation of the carriage 16 and is connected to the driving pulley 17*a*. In addition, an endless timing belt 17 connected to the carriage 16 is suspended between the pair of the pulleys 17*a* and 17*b*. Accordingly, the carriage 16 is guided along the guide shaft 15 to move in the right and left direction via the endless timing belt 17 being driven by the carriage motor 18.

A printing head 19, which acts as a liquid ejecting head is provided in the carriage 16. An ink cartridge 20 capable of storing a plurality of ink (a liquid) is detachably mounted to the printing head 19 In addition, as shown in FIG. 2, the ink stored in the ink cartridge 20 is supplied to nozzles 22 formed on a nozzle formation surface 19*a* on the bottom surface of the printing head 19 by driving a plurality of piezoelectric elements 21 included in the ink cartridge 20.

Moreover, a home position area where the carriage 16 is located when the printing head 19 is not performing a printing operation is formed in the right end of the frame 12 where the paper sheet P does not reach. In some instances, the carriage 16 is placed in the home position where a maintenance unit 23 for performing various maintenances is provided so that the printing head 19 may periodically undergo cleaning operations so that ink ejecting operations may be successfully performed on the paper sheet P.

Next, the maintenance unit 23 will be described below with reference to FIG. 2.

Figure 2:
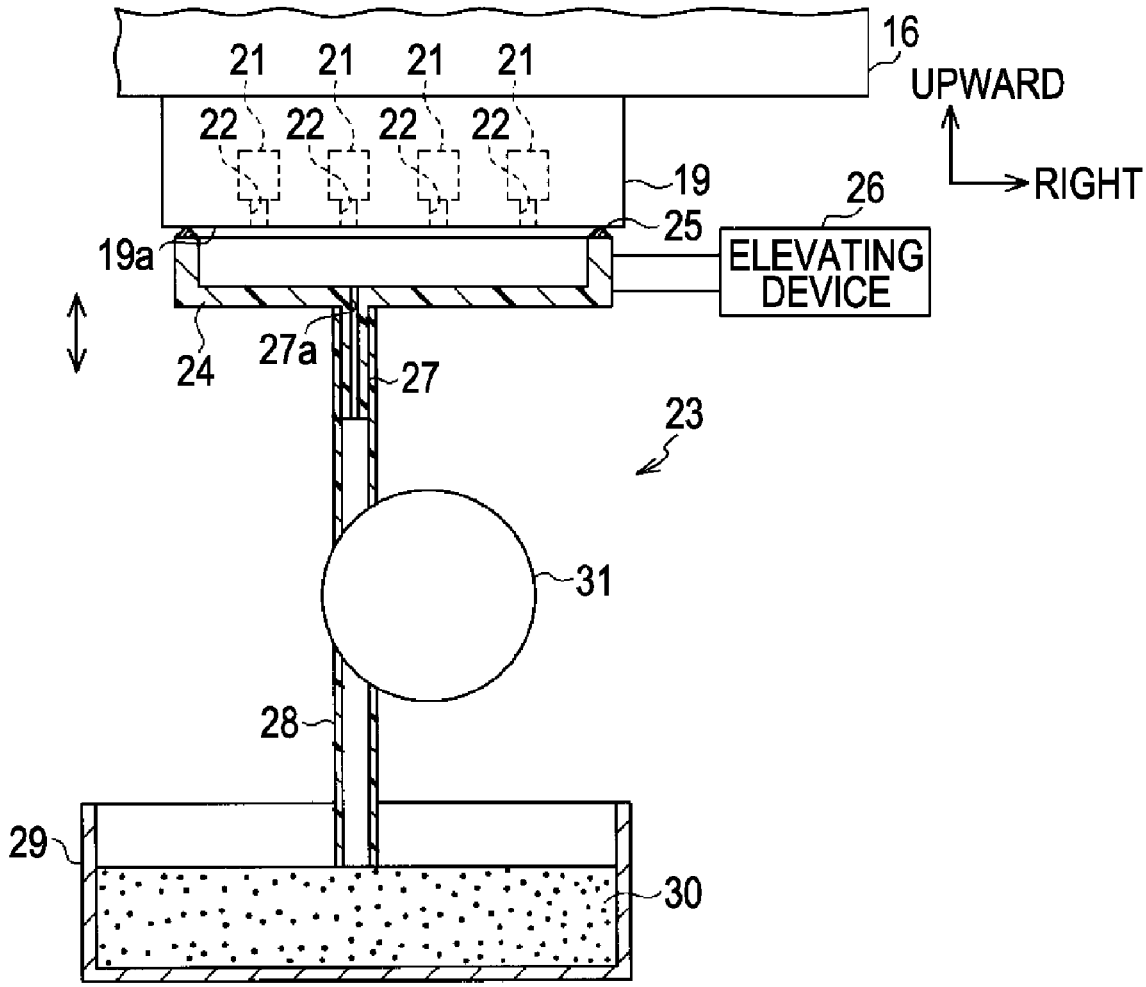
FIG. 2 is a schematic view illustrating a maintenance unit according to the embodiment.

As shown in FIG. 2, the maintenance unit 23 includes a rectangular box-like cap 24 made of a synthetic resin which is disposed in the nozzle formation surface 19*a* of the printing head 19 in the area where the openings of the nozzles 22 are formed The cap 24 has a bottom surface and the upper portion of the cap 24 is opened. The cap 24 is capable of contacting the nozzles 22 so as to cover the nozzles 22. A sealing member 25 with a rectangular box shape formed of a flexible material, such as rubber, is provided across the upper surface of the cap 24.

An elevating device 26 capable of elevating the cap 24 is connected to the cap 24. When the carriage 16 is moved to the non-printing area, the cap 24 covers the nozzles 22 of the printing head 19 by elevating the cap 24 using the elevating device 26 so as to bring the upper surface of the sealing member 25 in close contact with the nozzle formation surface 19*a* of the printing head 19. The state wherein the sealing member 25 of the cap 24 comes in contact with the nozzle formation surface 19*a* of the printing head 19 is referred to a "contact state" below.

The discharging portion 27 includes a discharging opening 27*a* for discharging the ink from the inside of the cap 24 to the outside of the cap 24. The discharging portion 27 is provided on the lower surface of the cap 24 so as to extend to the downside of the cap 24. One end (upstream side) of a discharging tube 28 is formed of a flexible material and is connected to the discharging portion 27. The other end (downstream side) of the discharging tube 28 is inserted into a waste ink tank 29 Accordingly, the inside of the cap 24 and the inside of the tank 29 communicate with each other through the discharging tube 28. In addition, the ink flowing in the tank 29 is configured to be absorbed by an ink absorbing member 30 provided in the tank 29.

A tube pump 31 (also called "a sucking pump") is located near the middle of the discharging tube 28, a and is capable sucking the ink from the cap 24. In addition, when the sealing member 25 of the cap 24 comes in contact with the nozzle formation surface 19*a* of the print head 19 so as to cover the nozzles 22, the tube pump 31 is driven. This process comprises a cleaning operation that is performed when ink viscosity is increased, in order to remove the thickened ink and any bubbles from the nozzles 22 and discharge the waste ink to the inside of the tank 29 through the cap 24 and the discharging tube 28.

Next, the tube pump 31 according to embodiments of the present invention will be described below with reference to FIGS. 3 to 11.

Figure 3:
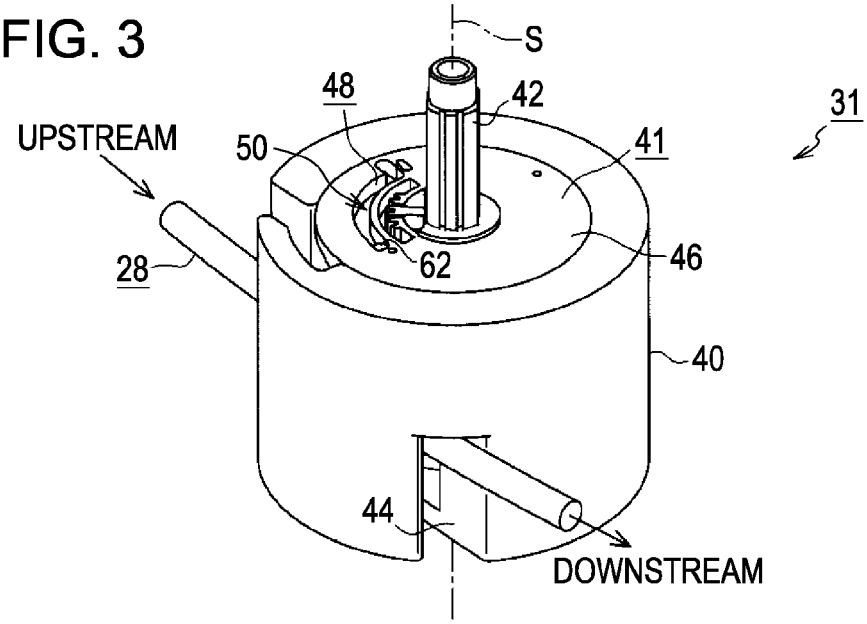
FIG. 3 is a perspective view illustrating a tube pump according to the embodiment.
Figure 4:
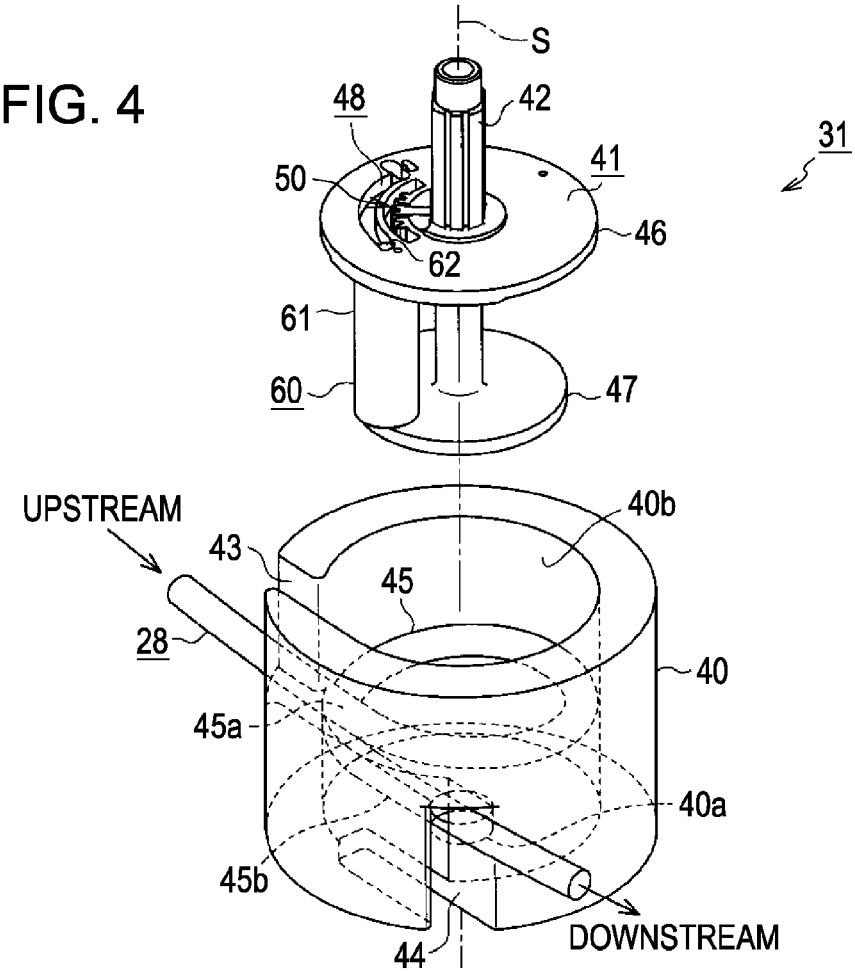
FIG. 4 is an exploded perspective view illustrating the tube pump according to the embodiment.

As shown in FIGS. 3 and 4, the tube pump 31 includes a cylindrical housing 40 with a bottom surface that is fixed on the inside of the frame 12 (see FIG. 1) of the printer 11. A hole 40*a* is formed in the center of the bottom surface of the housing 40. A pump foil 41 is housed to on the housing 40 and is capable of rotating on a rotation axis S which passes through the center of the housing 40. That is, the pump foil 41 extends along the S axis and includes a foil shaft 42 which is inserted into the hole 41*a*. Thus, the pump foil 41 is configured so as to rotate along the foil shaft 42 in the housing 40.

An inlet 43 and an opposing outlet 44 are formed in the housing 40 as tangents to the inner circumference 20*b* of the housing 40 In this case, the positions of the inlet portion 43 and the outlet portion 44 do not lie along the rotation axis S. In addition, the middle 45 of the discharging tube 28 is housed in the housing 40 so as to be wound along the inner circumference 40*b* of the housing 40 through the inlet 43 and outlet 44. In this case, a portion of the upstream and downstream portion of the discharging tube 28 overlap each other.

Figure 5:
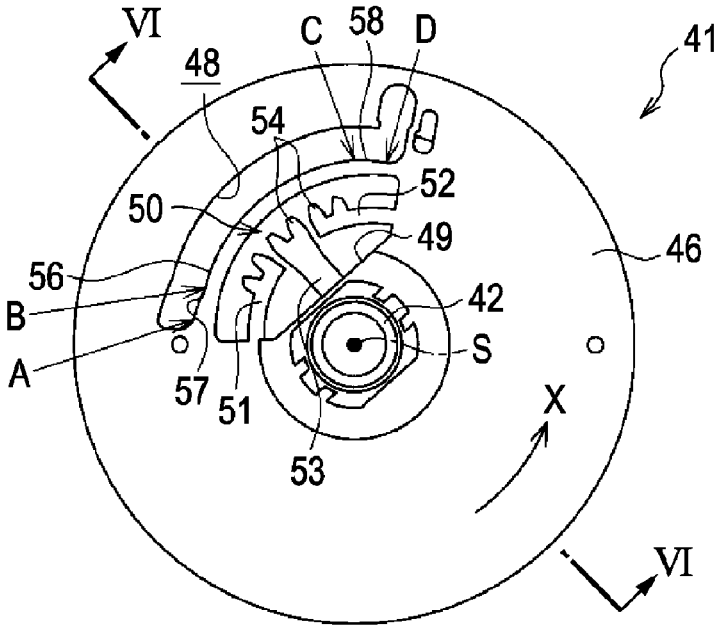
FIG. 5 is a top view of a pump foil according to the embodiment.

As shown in FIG. 4, the pump foil 41 includes a large disk-like plate 46 and a smaller plate 47 having a diameter that is smaller than that of the large plate 46. The foil shaft 42 is formed through the center of the large plate 46 and the small plate 47 which are attached to the ends of the foil shaft 42 and separated by a predetermined distance. As shown in FIG. 5, a roller guide groove 48 with an arc-like shape is formed through the large plate 46 with a portion that extends toward the outer edge of the pump foil 41. One end of the roller guide groove 48 corresponds with a pump non-operating position. The pump non-operating position is formed in the inner circumference of the large plate 46 in the roller guide groove 48. In contrast, the other end of the roller guide groove 48 corresponds with a pump operating. The roller guide groove 48 that extends close to the edge of the large plate 46 corresponds with the pump operating position, while the other end corresponds with the pump operation position.

A rack opening 49 having a fan-shaped sectional surface is formed through the large plate 46 between the roller guide groove 48 and a foil shaft 42. In addition, a rack member 50 is provided within the rack opening 49. The rack member 50 is comprised of a first extension portion 51, second extension portion 52, and third extension portion 53, which each comprise an arc-like shape with a plurality of teeth 54 that extend about a rotation axis S from one edge of the rack opening 49 to the opposite edge of the rack opening 49. The teeth 54 of each of the extension portions 51, 52, and 53 extend an equal distance from the rotation axis S, and the third extension portion 53 is arranged between the first extension portion 51 and the second extension portion 52 so as to be separated by a predetermined distance. In the preferred embodiment, two teeth are formed in each of the extension portions 51, 52, and 53. That is, the rack portion 50 in this embodiment is incorporated with the large plate 46, and comprises a toothed wheel in which the plurality of teeth 54 are intermittently arranged.

Figure 6:
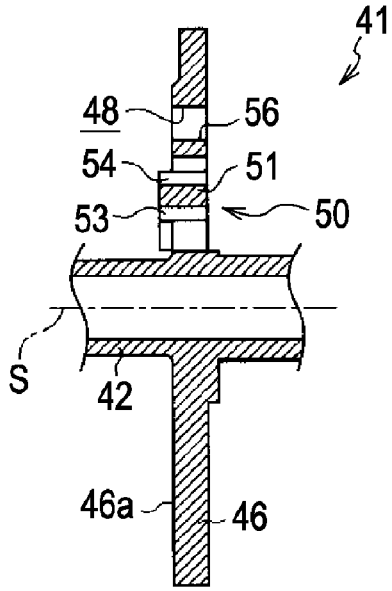
FIG. 6 is a sectional view illustrating the pump foil taken along the arrow VI-VI in FIG. 5 according to the embodiment.

As shown in FIG. 6, the rack portion 50 is formed to be thicker in the rotation axis S than the other portions of the large plate 46. That is, a portion of the rack portion 50 protrudes further toward the small plate 47 than the opposite surface 46*a* of the large plate 46.

Figure 7:
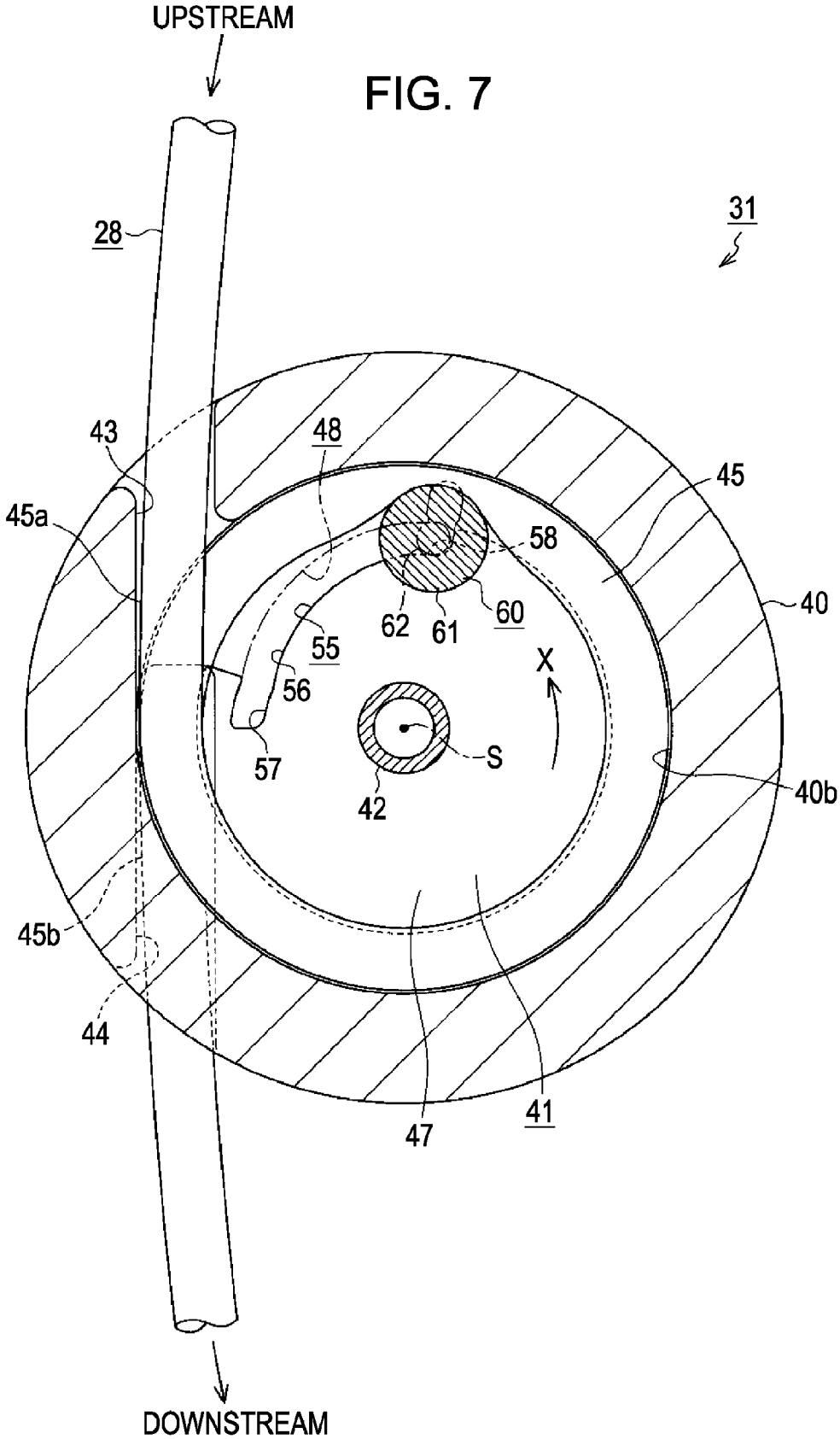
FIG. 7 is a top sectional view illustrating the tube pump according to the embodiment.

As shown in FIG. 7, a roller guide concave portion 55 is formed in the roller guide groove 48 of the large plate 46. The inner circumference of the roller guide groove 48 of the large plate 46 and an inner circumference of the roller guide concave portion 55 of the small plate 47 form a cam surface 56.

Next, the shape of the roller guide groove 48 of the large plate 46 and roller guide concave portion 55 of the small plate 47 will be described below with reference to FIGS. 5, 7, and 8.

As shown in FIGS. 5 and 7, in the cam surface 56 of the roller guide groove 48 and the roller guide concave portion 55 formed in one end of the roller guide groove 48 which is closer to the rotation axis S correspond to a pump non-operating area 57. In addition, in the cam surface 56 of the roller guide groove 48 and the roller guide concave portion 55 correspond to the pump operating position.

Figure 8:
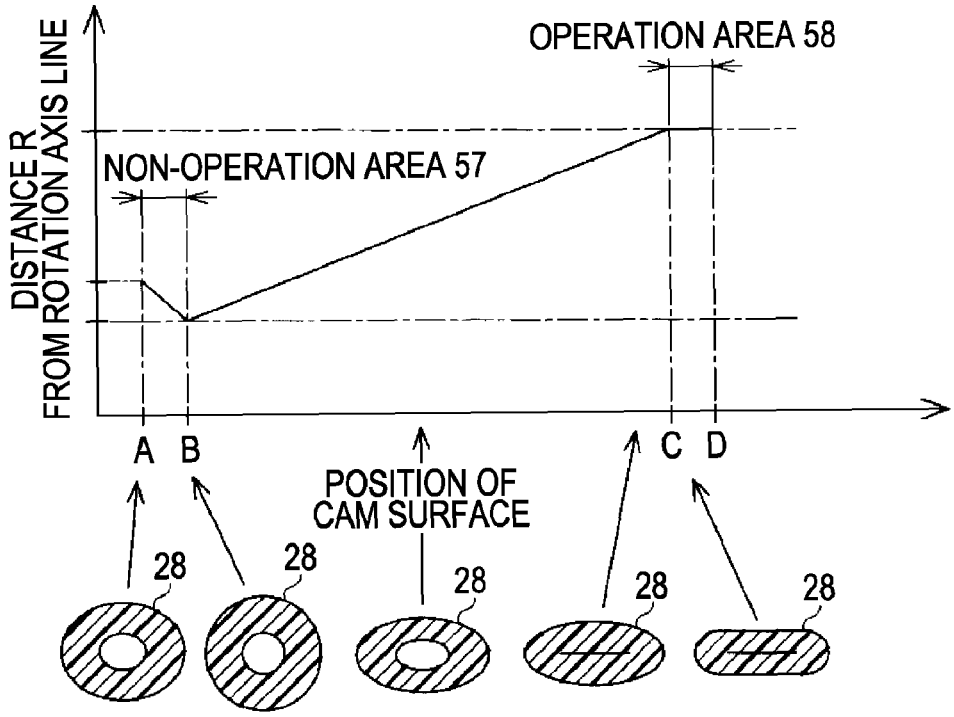
FIG. 8 is a diagram for explaining the shape of a cam surface according to the embodiment.

As shown in FIG. 8, the pump non-operating area 57 of the cam surface 56 are a smaller distance from the rotation axis than the pump operating area 58. In addition, the distance between the roller guide groove 48 and the rotation axis S is gradually increased between the second position B and the first position A. That is, the pump non-operating area 57 of the roller guide groove 48 are further from the rim of the plates 46 and 47 than the pump operating area 58.

The distance between the pump operating area 58 and rotation axis is the same between the third position C and the fourth position D That is, the roller guide groove 48 between the pump operating area 58 and the roller guide concave portion 55 comprises an arc shape that is a constant distance from the rotation axis S between the third position C and the fourth position D.

The distance between the rotation axis S of the pump foil 41 and the roller groove guide 48 in the portion between the second position B and the third position C gradually increases between the second position B and the third position C.

Figure 9:
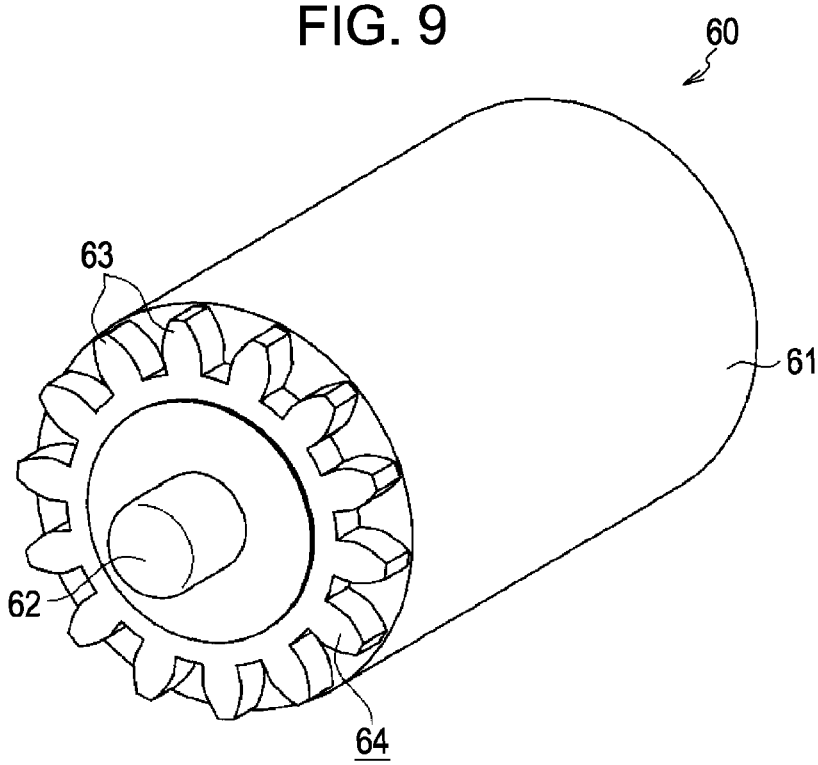
FIG. 9 is a perspective view illustrating a pressing member according to the embodiment.
Figure 10:
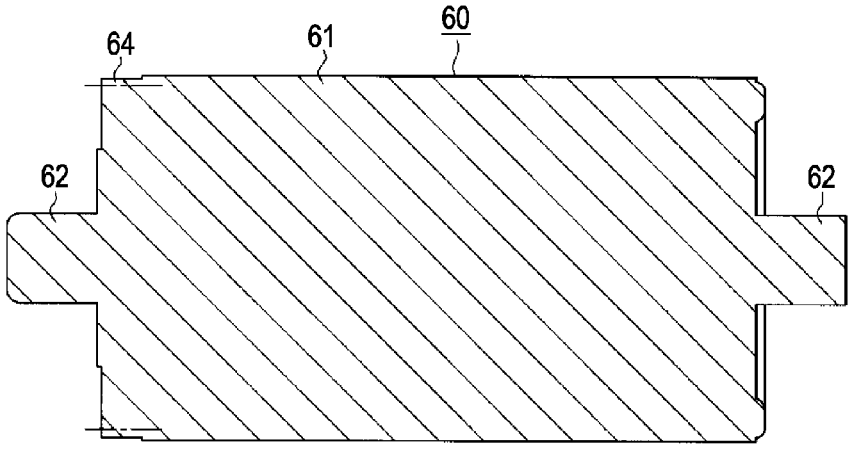
FIG. 10 is a side sectional view illustrating the pressing member according to the embodiment.

As shown in FIG. 4, the pump foil 41 supports a pressing member 60 for pressing the middle portion 45 of the discharging tube 28 housed in the housing 40 while it moves along the roller guide groove 48 in the roller guide concave portion 55. As shown in FIGS. 9 and 10, the pressing member 60 includes a roller 61 with substantially cylindrical shape and a shaft 62 protruding from both ends of the roller 61. The shaft 62 of the pressing member 60 is supported so as to cause the pressing member 60 to slide along the roller guide groove 48 between the large plate 46 and the roller guide concave portion 55 of the small plate 47. In addition, when the pressing member 60 moves along the roller guide groove 48 and the roller guide concave portion 55, the shaft 62 of the pressing member 60 comes in sliding contact with the cam surface 56 of the roller guide groove 48 and the roller guide concave portion 55.

Figure 11A:
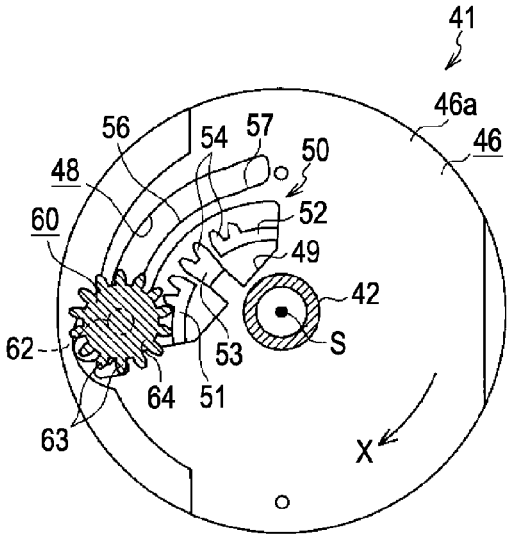
FIG. 11A is a top sectional view illustrating the pressing member positioned in a pump operation position.
Figure 11B:
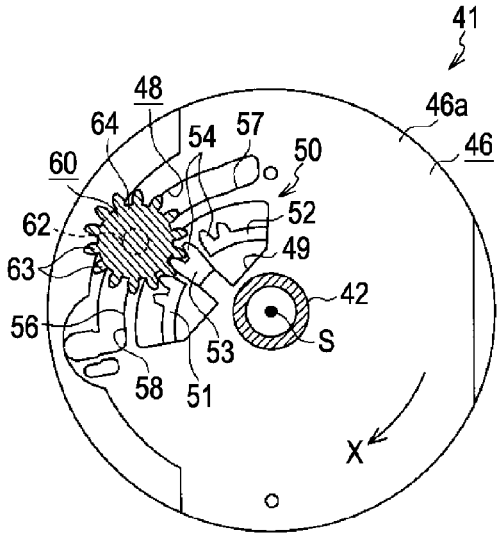
FIG. 11B is a top sectional view illustrating a pinion member of the pressing member engaging with a rack member.

A pinion portion 64 is formed in one end of the roller 61 that corresponds with the large plate 46. The pinion portion 64 comprises a plurality of teeth 63 arranged along the circumference of the roller 61 about the shaft 62 at equal intervals, and is incorporated with the roller 61 of the pressing member 60. When the pressing member 60 moves from the pump operating position of the roller guide groove 48 to the pump non-operating position, as shown in FIGS. 11A and 11B, the pinion portion 64 is configured to engage with the rack portion 50. On the other hand, when the pressing member 60 is positioned entirely in either the pump non-operating position or pump operating position of the roller guide groove 48, the pinion portion 64 of the pressing member 60 does not engage with the rack portion 50.

As shown in FIG. 8, when the shaft 62 comes in contact with the first position A of the cam surface 56 when the pressing member 60 is positioned at the pump non-operating position of the roller guide groove 48, the pressing member 60 slightly compresses the middle portion 45 of the discharging tube 28, causing a slight reaction force, which does not generate a negative pressure in the discharging tube 28. On the other hand, when the shaft 62 comes in contact with the second position B of the cam surface 56 when the pressing member 60 is positioned at the pump non-operating position of the roller guide groove 48, no pressing force is applied to the discharging tube 28.

In comparison, the pressing member 60 either gradually increases the pressure on the middle portion 45 of the discharging tube 28 and deforms the discharging tube as the shaft 62 approaches the third position C from the second position B. Then, the pressing member 60 is configured to close the middle portion 45 of the discharging tube 28 when the shaft 62 approaches the position closest to the third position C of the cam surface 56.

Then, the pressing member 60 is configured to completely close the middle portion 45 of the discharging tube 28 as the shaft 62 moves from the third position C to the fourth position D of the pump operating position. As described above, the pressing member 60 is configured to close the middle portion 45 of the discharging tube 28 from an area close to the third position C to the fourth position D of the cam surface 56. Accordingly, in this embodiment, it is possible to also suck ink or bubbles from the cap 24 when the shaft 62 as the pressing member 60 approaches the third position C of the cam surface 56.

Next, a method of driving the tube pump 31 according to this embodiment will be described below. In a pump non-operating process, the shaft 62 of the pressing member 60 is positioned at the first position A of the pump non-operating area of the cam surface 56.

When the pump foil 41 starts to rotate in the X direction about the rotation axis S in order to drive the tube pump 31, the pressing member 60 starts to move in the counter-X direction along the cam surface 56 formed in the roller guide groove 48 of the large plate 46 and the roller guide concave portion 55 of the small plate 47. At this time, a pressing force is applied to the shaft 62 of the pressing member 60 positioned at the first position A from the discharging tube 28 based on the reaction force. This pressing force causes the pressing member 60 to slide in the counter-X direction in the roller guide groove 48, causing the pressing member 60 to become gradually closer to rotation axis S.

Subsequently, the pressing member 60 continues to slide from the second position B toward the pump operating position as the shaft 62 is slid from the first position A to the second position B. Then, the pinion member 64 of the pressing member 60 engages with the rack member 50 incorporated with the large plate 46. Then, the pressing member 60 is rotatably slid toward the pump operating position.

At this time, since the pressing member 60 presses the discharging tube 28, the reaction force (that is, an elastic restoration force of the discharging tube 28) from the discharging tube 28 is applied to the pressing member 60. Accordingly, the shaft 62 of the pressing member 60 continues to contact with the cam surface 56, and the pinion member 64 continues to engage with the rack member 50. Accordingly, in this embodiment, a sliding speed of the pressing member 60 from the pump non-operation position to the pump operation position is substantially uniform every time, irrespective of irregularity of the reaction force of the discharging tube 28 or irregularity of the friction between the pressing member 60 and the pump foil 41.

When the pressing member 60 reaches the pump operating position, the engagement of the pinion member 64 of the pressing member 60 and the rack member 50 is released. Thus, the inner surface of the discharging tube 28 becomes closed when the pressing member 60 presses the discharging tube 28. As the pump foil 41 continues to rotate in the X direction, the pressing member 60 positioned at the pump operating position is slid along the inner circumference 40*b* of the housing 40 while pressing a portion of the discharging tube 28. At this time, since there is no engagement between the pinion member 64 and the rack member 50, the pressing member 60 can rotate about the shaft 62 at the pump operating position.

Since the portion of the discharging tube 28 pressed by the pressing member 60 is sequentially restored by the sliding movement of the pressing member 60, the upstream discharging tube 28 has a pressure that is less than the midway portion 45 housed in the housing 40. Accordingly, the inside of the cap 24 communicating with the upstream side rather than the midway portion 45 of the discharging tube 28 is in the negative pressure state with respect to the atmosphere. As such, the ink or air may be sucked through the cap 24 by the tube pump 31 and discharged to the tank 29.

In the pump operating process, a reaction force from the discharging tube 28 is applied against the pressing member 60 toward the inner diameter of the pressing member 60. However, the pump operating area 58 of the cam surface 56 is formed with an arc shape with a constant distance from the rotation axis S. Accordingly, the pressing member 60 positioned at the pump operating position does not slide toward the pump non-operating position by the reaction force from the discharging tube 28.

On the other hand, when the tube pump 31 is set to a non-operating state, the pump foil 41 is moved in the counter-X direction so as to release the negative pressure of the discharging tube 28. Then, the pressing member 60 positioned at the pump operating position starts to slide in the X direction. In addition, when the pressing member 60 starts slide from the pump operating position to the pump non-operating position, the pinion member 64 of the pressing member 60 engages with the rack member 50. Accordingly, the pressing member 60 is rotatably slid toward the pump non-operating position while the pinion member 64 engages with the rack member 50. Subsequently, when the pressing member 60 reaches the pump non-operating position, there is no engagement between the pinion member 64 and the rack member 50. Accordingly, the pressing member 60 can rotate about the shaft 62 at the pump non-operating position. Afterward, when the rotation of the pump foil 41 stops, the rotation of the pressing member 60 also stops.

In this embodiment, the following advantages can be obtained.

(1) During the pump operation process, the pressing member 60 is capable of rotatably sliding from the pump non-operating position to the pump operating position while the pinion member 64 engages with the rack member 50. Accordingly, the movement speed of the pressing member 60 does not vary due to irregularity of the friction, unlike the examples known in the art wherein the pressing member 60 is moves from the pump non-operating position to the pump operating position using the friction caused by the cam surface 56 of the pump foil (rotating member) 41. Therefore, it is possible to suppress any sliding movement irregularity of the pressing member 60 between the pump non-operating position to the pump operating position. Moreover, since the shaft 62 of the pressing member 60 is capable of reliably sliding along the cam surface 56, it is possible to suppress any irregular movement of the pressing member 60.

(2) In configurations known in the art, when the rack member 50 engages with the pinion member 64 of the pressing member 60 when the pressing member 60 is positioned at the pump operating position, the reaction force (elastic restoration force) of the closed discharging tube 28 is applied to the rack member 50 through the pinion member 64 of the pressing member 60, often damaging the teeth 54 of the rack member 50. In this embodiment, however, the rack member 50 is configured so as not to engage with the pinion member 64 of the pressing member 60 when the pressing member 60 is positioned at the pump operating position. Accordingly, it is possible to suppress the damage of the teeth 54 of the rack member 50 in the pump operating process.

(3) In the configurations of the known art, when the rack member 50 engages with the pinion member 64 of the pressing member 60 when the pressing member 60 is positioned at the pump non-operating position, a load from the pressing member 60 is generated in the rack member 50. In order to solve this problem, when the pressing member 60 is positioned at the pump non-operating position in this embodiment, the rack member 50 is configured so as not to engage with the pinion member 64 of the pressing member 60. Thus, since the period of time when the pinion member 64 and the rack member 50 are engaged with each other is reduced, it is possible to increase the durability of the rack member 50.

(4) The pump operating area 58 of the cam surface 56 is formed in the arc shape about the rotation axis S of the pump foil 41. Accordingly, when a reaction force is applied toward the rotation axis S in response to the discharging tube 28 being closed by the pressing member 60 positioned at the pump operating position during the pump operating process, the shaft 62 of the pressing member 60 does not move in the circumferential direction in the pump operating area 58 of the cam surface 56. Therefore, it is possible to control movement of the pressing member 60 from the pump operating position to the pump non-operating position during the pump operating process.

(5) In the pump non-operating area 57 of the cam surface 56, the distance from the rotation axis S is increased as the pressing member 60 moves from the pump operating area 58. Accordingly, when the pressing member positioned at the pump non-operating position starts to slide toward the pump operating position, the pressing member 60 is gradually moved toward from the rotation axis S. Then, as the pressing member 60 starts to slide from the pump non-operating position to the pump operating position, and the pinion member 64 of the pressing member 60 engages with the rack member 50. Accordingly, the pinion member 64 of the pressing member 60 is more easily engaged with the rack member 50 as compared to the case where the force is not applied to the cam surface 56. Therefore, the pressing member 60 can be rapidly moved to the pump operating position.

(6) The first extension portion 51 and the second extension portion 52 of the rack member 50 are flexible since only the base ends thereof are fixed to the large plate 46. Accordingly, when the reaction force of the discharging tube 28 is increased as the pressing member 60 moves from the pump non-operating position to the pump operating position, the first extension portion 51 and the second extension portion 52 are capable of bending, thereby maintaining good engagement between the pinion member 64 of the pressing member 60 and the rack member 50. On the other hand, when the reaction force of the discharging tube 28 decreases when the pressing member 60 slides from the pump operation position, the first extension portion 51 and the second extension portion 52 are capable of returning to their original positions, thereby maintaining good engagement between the pinion member 64 of the pressing member 60 and the rack member 50. That is, the first extension portion 51 and the second extension portion 52 of the rack member 50 have flexibility. Accordingly, even they bend in response to the reaction of the discharging tube 28, a good engagement of the pinion member 64 of the pressing member 60 and the rack member 50 can be maintained.

(7) Since the rack member 50 is incorporated with the large plate 46, it is not necessary to increase the number of elements of the tube pump 31. Moreover, it is possible to suppress the irregularity of the sliding movement speed of the pressing member 60.

(8) The irregularity of the sliding speed (movement speed) of the pressing member 60 from the pump non-operating position to the pump operating position in the tube pump 31 is suppressed. Accordingly, it is possible to suppress the suction in the cap (liquid storage member) 24 at the time of starting drive of the tube pump.

The above-described embodiment may be modified in various forms.

In the above-described embodiment, the distance from the rotation axis S may be the smallest at the first position A of the pump non-operating area 57 of the cam surface 56. With such a configuration, it is possible to obtain the same advantages of (1) to (4) and (6) to (8).

In the above-described embodiment, the distance from the rotation axis S in the pump operating area 58 of the cam surface 56 may become longer from the third position c to the fourth position D. With such a configuration, it is possible to obtain the same advantages of (1) to (3) and (5) to (8).

In the above-described embodiment, the front ends of the extension portions 51 to 53 of the rack member 50 may be adjacent to each other. With such a configuration, it is possible to obtain the same advantages of (1) to (8).

In the above-described embodiment, the first extension portion 51 and the second extension portion 52 may not have the described flexibility.

In the above-described embodiment, the rack member 50 may be configured so as to be separate from the large plate 46. In this case, it is desirable that the rack member 50 is arranged on the surface of the large plate 46 that is opposite to the small plate 47.

In the above-described embodiment, the rack member 50 may be provided in the small plate 47. In this case, it is desirable that the pinion member 64 is formed in the end of the small plate 47 of both ends of the roller 61.

In the above-described embodiment, the pinion member 64 may be configured so as to be separated from the roller 61 of the pressing member 60.

In the above-described embodiment, the tube pump 31 may be configured so as to have a plurality of pressing members 60 (for example, two pressing members). In this case, it is desirable that the same number of the roller guide grooves 48 is formed through the large plate 46 as the number of the pressing member 60 and that the same number of the roller guide concave portions 55 is formed in the small plate 47 as the number of the pressing members 60.

In the above-described embodiment, the tube pump 31 may be configured so that the middle portion 45 of the discharging tube 28 is wound once around the housing 40, in a so-called Ω shape. In another embodiment, the tube pump 41 may be configured so that the midway portion 45 of the discharging tube 28 is wound ¾ of the way around the housing 40, in a so-called U shape. However, if the midway portion 45 of the discharging tube 28 in the housing 40 is wound in the U shape, it is desirable that the pressing members 60 are arranged in both sides of the center of the housing 40.

In the above-described embodiment, the roller 61 and the shaft 62 of the pressing member 60 may be configured so as to be separate from each other.

In the above-described embodiment, the liquid ejecting apparatus may be embodied in a so-called off-carriage type ink jet printer in which the ink cartridge 20 is disposed in a portion other than the carriage 16. In this case, ink is supplied from the ink cartridge 20 to the printing head 19 mounted in the carriage 16 through a supply tube.

In another variation of the present embodiment, the liquid ejecting apparatus may be embodied in a so-called full line type printer wherein the printing head 19 is configured so as to correspond to the length in a transverse direction of the paper sheet P in a direction intersecting a transport direction (front and rear directions) of the paper sheet P.

In the previously described embodiment, the liquid ejecting apparatus is embodied in the ink jet printer 11, however, the invention is not limited thus, and may be applied in a liquid ejecting apparatus capable of ejecting another liquid other than ink, such as a liquid state solution wherein particles of a functional material are ejected or mixed with a liquid, a fluid state solution such as gel, or a solid which is capable of flowing like a liquid. Moreover, the liquid consuming apparatus having the liquid ejecting head may comprise a liquid ejecting apparatus capable of ejecting electrode material or a color material (pixel material), an apparatus used to manufacture a color filter such as a liquid crystal display, an EL (electroluminescence) display, or a field emission display. Furthermore, the liquid ejecting head may be capable of ejecting the electrode material or the color material in form of a solution. The liquid ejecting apparatus may be capable of ejecting a bio-organic matter used to manufacture a bio-chip, or a liquid ejecting apparatus capable of ejecting a sample as a precise pipette. Moreover, the present invention may be used in association with a liquid ejecting apparatus capable of ejecting a lubricating oil to a precision apparatus such as a watch or a camera using a pin point, a liquid ejecting apparatus capable of ejecting a transparent resin liquid such as an ultraviolet curing resin to form a minute hemispherical lens (optical lens) used in an optical communication element, a liquid ejecting apparatus capable of ejecting an etching liquid such as an acid liquid or an alkali liquid to perform etching on a substrate or the like, a liquid ejecting apparatus capable of ejecting a liquid such as gel, or a particulate ejecting apparatus capable of ejecting particulates such as toner, such as a toner ejecting apparatus comprising an ink jet printing apparatus. The invention may also be applied to any liquid ejecting apparatus thereof. In this embodiment, "a liquid" refers to a liquid no containing a fluid consisted of only a gas. The liquid may comprise an inorganic solvent, an organic solvent, a solution, a liquid-state resin, a liquid-state metal (molten metal liquid)), a liquid solution, a particulate (including a fine particle), or the like.

What is claimed is:

1. A tube pump comprising:

a portion of a tube made of a flexible material;

a pressing member capable of generating a negative pressure in the portion of tube by sequentially pressing the portion of the tube as the pressing member moves from an upstream portion of the tube to a downstream portion of the tube during a pump operating process;

a rotating member which includes a cam surface which the pressing member comes into sliding contact with when the pressing member moves between a pump operating position where a negative pressure is generated in the upstream portion of the tube and a pump non-operating position where a negative pressure is not generated in the upstream portion of the tube; and a rack member corresponding to the cam surface and which includes a plurality of teeth, wherein the pressing member is provided with a pinion member which is capable of continuously engaging with a flexible portion of the rack member when the pressing member rotatably moves between the pump non-operating position and the pump operating position.

2. The tube pump according to claim 1, wherein the plurality of teeth of the rack member are formed in the flexible portion of the rack member.

3. The tube pump according to claim 1, wherein the rack member is formed so as not to engage with the pinion member of the pressing member when the pressing member is positioned at the pump operating position.

4. The tube pump according to claim 1, wherein the rack member is formed so as not to engage with the pinion member of the pressing member when the pressing member is positioned at the pump non-operating position.

5. The tube pump according to claim 1, wherein the cam surface is formed so that distance between an inner edge of the cam surface and a rotation axis of the rotating member is the same in a pump operating area of the cam surface which corresponds to the pump operating position.

6. The tube pump according to claim 1, wherein the cam surface is formed so that distance from an inner edge of the cam surface and a rotation axis of the rotating member is gradually increases between a pump non-operating area of the cam surface corresponding to the pump non-operating position and a pump operating area of the cam surface corresponding to the pump operating position.

7. A liquid ejecting apparatus comprising:

a liquid ejecting head capable of ejecting a liquid from a nozzle;

a liquid storage member capable of coming into contact with the liquid ejecting head; and a sucking member capable of sucking the liquid from the nozzle of the liquid ejecting head and discharging the liquid into the liquid storage member when the liquid storage member comes in contact with the liquid ejecting head, wherein the sucking member comprises the tube pump according to claim 1.

8. A method of driving a tube pump wherein a pressing member sequentially presses a portion of a flexible tube while sliding along a cam surface in order to generate a negative pressure in an upstream portion of the flexible tube in a pump operating process, the method comprising:

providing a rack member corresponding to the cam surface and which has a plurality of teeth;

providing the pressing member with a pinion member capable of engaging with the rack member; and rotatably moving the pressing member from a pump non-operating position wherein a negative pressure is not generated in the upstream portion of the flexible tube to a pump operating position wherein the negative pressure is generated in the upstream portion of the flexible tube while engaging the pinion member with the rack member, wherein the rack member has a flexible portion so as to continuously engage with the pinion member as the pressing member moves from the pump-non operating position to the pump operating position.

9. The method of claim 8, wherein the plurality of teeth of the rack member are formed in the flexible portion of the rack member.

10. The method of claim 8, wherein the rack member is formed so as not to engage with the pinion member of the pressing member when the pressing member is positioned at the pump operating position.

11. The method of claim 8, wherein the rack member is formed so as not to engage with the pinion member of the pressing member when the pressing member is positioned at the pump non-operating position.

12. The method of claim 8, wherein the cam surface is formed so that distance between an inner edge of the cam surface and a rotation axis of the rotating member is the same in a pump operating area of the cam surface which corresponds to the pump operating position.

13. The method of claim 8, wherein the cam surface is formed so that distance from an inner edge of the cam surface and a rotation axis of the rotating member is gradually increases between a pump non-operating area of the cam surface corresponding to the pump non-operating position and a pump operating area of the cam surface corresponding to the pump operating position.

* * * * *